US006539575B1

(12) United States Patent
Cohen

(10) Patent No.: US 6,539,575 B1
(45) Date of Patent: Apr. 1, 2003

(54) AGITATOR FOR A CLEANING MACHINE WITH MATERIAL CUTTING CHANNEL

(75) Inventor: Shane P. Cohen, New Orleans, LA (US)

(73) Assignee: Oreck Holdings, LLC, Cheyenne, WY (US)

( * ) Notice: Subject to any disclaimer, the term of this patent is extended or adjusted under 35 U.S.C. 154(b) by 0 days.

(21) Appl. No.: 09/347,692

(22) Filed: Jul. 2, 1999

(51) Int. Cl.[7] ..... A46B 13/02; A46B 7/10

(52) U.S. Cl. ..... 15/179; 15/182; 15/364; 15/383; 15/366

(58) Field of Search ..... 15/182, 179, 383, 15/366, 364, 384

(56) References Cited

U.S. PATENT DOCUMENTS

| | | | | |
|---|---|---|---|---|
| 1,372,622 A | * | 3/1921 | Hoover | |
| 1,889,224 A | | 11/1932 | Smellie | 15/179 |
| 1,894,361 A | * | 1/1933 | Shank | 15/383 |
| 2,055,264 A | * | 9/1936 | Schottle | |
| 2,251,899 A | * | 8/1941 | Smellie | |
| 2,271,551 A | | 2/1942 | Hoover | 15/366 |
| 2,491,007 A | | 12/1949 | Koch | 69/20 |
| 3,597,789 A | | 8/1971 | Boyd | 15/383 |
| 4,084,282 A | | 4/1978 | Calvert | 15/38 |
| 4,173,807 A | | 11/1979 | Maier | 15/179 |
| 4,209,873 A | * | 7/1980 | Schaefer | 15/383 |
| 4,403,372 A | | 9/1983 | Keane et al. | 15/339 |
| 4,646,380 A | | 3/1987 | Kobayashi et al. | 15/41 R |
| 5,482,562 A | * | 1/1996 | Abernathy | 15/383 |
| 5,794,297 A | | 8/1998 | Muta | 15/42 |

FOREIGN PATENT DOCUMENTS

| | | | | |
|---|---|---|---|---|
| CA | 2068595 | * | 11/1993 | 15/246 |
| DE | 556153 | * | 8/1932 | 15/182 |
| EP | 0 313 403 A2 | | 4/1989 | |
| GB | 2 241 430 A | | 9/1991 | |
| JP | 406233731 | * | 8/1994 | 15/383 |

* cited by examiner

*Primary Examiner*—Gary K. Graham
(74) *Attorney, Agent, or Firm*—Faegre & Benson LLP

(57) ABSTRACT

An agitator for use with cleaning machines, as well as methods for making the same, are shown and described. The agitator is configured to facilitate the removal of elongated fibers therefrom. In one embodiment, the agitator has a rotatable member with opposing first and second ends, an axis of rotation extending between the first and second ends, and an external surface extending at least partially between the first and second ends. A number of projections are attached to the external surface of the agitator. One or both of the ends of the agitator are configured to rotatably engage the cleaning machine, such as at a bearing or other connector. The external surface of the rotatable member has a first portion that is substantially cylindrical about the axis of rotation, and a second portion separate from the first portion that has at least a first depression. The depression is configured to allow a user to insert a cutting tool partially into the depression and cut the fibers wrapped around the rotatable member.

10 Claims, 3 Drawing Sheets

AGITATOR FOR A CLEANING MACHINE WITH MATERIAL CUTTING CHANNEL

TECHNICAL FIELD

The present invention relates to cleaning machines and, in particular, to cleaning machines having agitators for use in cleaning floors, carpets, upholstery and other surfaces.

BACKGROUND OF THE INVENTION

Individuals often use cleaning machines, such as vacuum cleaners or carpet sweepers, to clean upholstery, floors and other surfaces and surface coverings. The typical cleaning machine has a base or head, such as a power nozzle on a vacuum cleaner, that is moved over the surface to be cleaned. In some cleaning machines, suction is provided which draws particles from a section of the surface being cleaned into the cleaning machine where the dirty air is passed through a bag in which the entrained particles are captured.

An agitator is often rotatably attached to the base or head to improve the effectiveness of the cleaning machine. The agitator typically has one or more projections that impinge on the surface being cleaned as the agitator rotates. A vacuum cleaner, for example, has a roller brush with bristles that brush the surface as the base or head is moved across the surface to be cleaned. As the vacuum cleaner moves over the surface, the roller brush rapidly rotates and the bristles repeatedly impinge on the surface. This contact between the bristles and the surface agitates dirt and other particles from the surface and improves the effectiveness of the vacuum cleaner. A carpet sweeper has a rotating blade that similarly impinges the surface being cleaned. An example of such a device is illustrated in U.S. Pat. No. 4,646,380.

The agitator typically rotates about an axle that rotates within a pair of bearings mounted either in the cleaning machine or in the agitator. The bearings allow the agitator to rotate with a minimal amount of resistance. A belt driven by a motor rotates the agitator when the motor is operating. The belt is wrapped around a pulley on the agitator and a pulley coupled to the motor. The rotational speed of the agitator is a function of the speed of the motor and the relative sizes of the two pulleys.

As the cleaning machine is moved over a surface, the projections on the agitator stir particles from the surface, which are collected by the cleaning machine. The projections also pick up elongated fibers, such as a string, carpet fibers or a strand of hair. The fibers can become wrapped around the agitator, and are thus not collected by the cleaning machine. If the fibers are not regularly removed from the agitator, the number of fibers wrapped around the agitator can increase to a point at which the effectiveness of the agitator decreases and can become damaged.

Users often can experience difficulty removing fibers from the agitator. Fibers are commonly removed from the agitator by hand, the user pulling on the end of the fibers and manually unrolling them from the agitator. Some users pull centrally on the fibers to partially separate them from the agitator, then cut or break the fibers and manually pull the smaller, cut pieces of fiber off of tile agitator. Removing fibers from the agitator can be a tedious task, as the fibers can be wrapped tightly around the agitator and difficult to grab. In addition, the fibers can be tangled and difficult to unwrap. In many cases, the user merely chooses not to remove the fibers from the agitator—accepting the reduced effectiveness of and possibility of damage to the cleaning machine.

Fibers left on the agitator can work their way to the ends of the agitator and become wrapped around one or both of the end axles. Fibers wrapped around the axles are even more difficult to remove than fibers wrapped around the agitator. In many cases, the agitator must be removed from the cleaning machine before the fibers can be removed from the axles. Fibers wrapped around the axles can significantly increase the friction between the agitator and the cleaning machine. Those fibers that work their way to the ends of the agitator can also become enmeshed with the axle bearings, drive belt, and/or belt pulleys.

Increased friction between the agitator and the cleaning machine or the agitator drive mechanism can damage the cleaning machine or reduce its effectiveness. As the friction increases, the rotational speed of the agitator may decrease, lessening its agitating effect and straining the drive motor. As the friction further increases, brushes in the drive motor can burn out, or the belt can begin to slip on one or both of the pulleys. A slipping belt can wear down on the pulley until it breaks. Once the belt breaks, the agitator stops spinning and the effectiveness of the cleaning machine is reduced considerably or lost.

SUMMARY OF THE INVENTION

The present invention is directed toward agitators, such as roller brushes, for use with cleaning machines for cleaning upholstery, floors or other surfaces or surface coverings, and that are configured to facilitate the removal of elongated fibers therefrom, as well as methods for making the same.

In one embodiment of the present invention, a roller brush has a rotatable member with opposing first and second ends, an axis of rotation extending between the first and second ends, and an external surface extending at least partially between the first and second ends. A number of projections, such as bristles, are attached to the external surface of the agitator. One or both of the ends are configured to rotatably engage the cleaning machine, such as through a support bearing or other connector. The external surface of the rotatable member has a first portion that is substantially cylindrical about the axis of rotation, and a second portion spaced inwardly from the first portion to form a depression. The depression is configured to allow a user to insert a cutting tool partially into the depression and cut the fibers wrapped around the rotatable member. Once cut, the vacuum can be uprighted and turned on to vacuum up the cut fibers. The fibers may never need to be touched or disposed of by the user.

DETAILED DESCRIPTION OF THE INVENTION

The present invention is generally directed toward agitators for use with cleaning machines for cleaning upholstery, floors or other surfaces and surface coverings, and that are configured to facilitate the removal of elongated fibers therefrom, as well as methods for making the same. Many specific details of certain embodiments of the invention are set forth in the following description and in FIGS. 1–10 to provide a thorough understanding of such embodiments. One skilled in the art, however, will understand that the present invention may have additional embodiments, or that the invention may be practiced without several of the details described in the following description.

Figure 1:
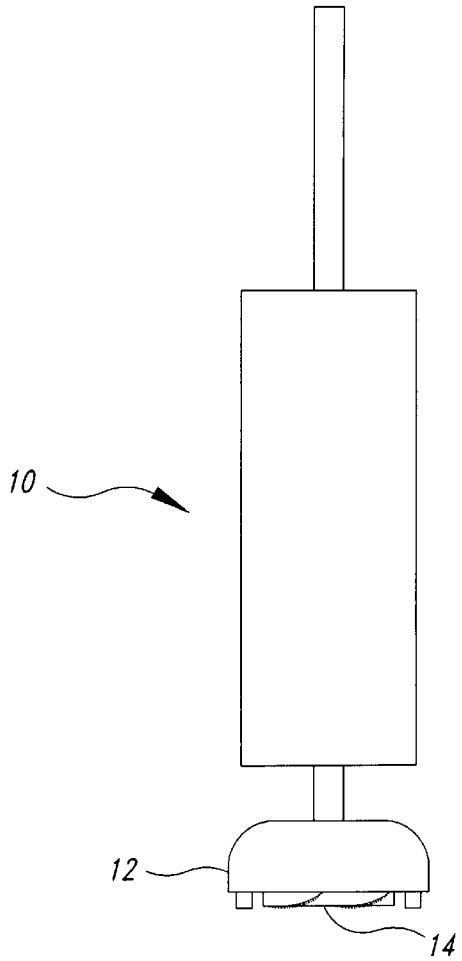
FIG. 1 is an elevation view of a cleaning machine with an agitator in the form of a roller brush according to one embodiment of the present invention.

FIG. 1 illustrates a cleaning machine 10 having a base 12 with an agitator in the form of a roller brush 14 according to one embodiment of the present invention. The illustrated cleaning machine 10 is an upright vacuum cleaner. The invention, however, is directed to any cleaning machine 10 that uses an agitator, such as a canister vacuum cleaner having a wand with a powered head, a carpet sweeper, or any other such machine. The cleaning machine 10 illustrated in FIG. 1 is in the upright position with the base 12 at the bottom. During operation, the base 12 rests on a floor, floor covering, upholstery or other surface (not shown), with the roller brush 14 oriented toward the surface being cleaned. The base 12 can be moved over the surface to remove dirt therefrom.

Figure 2:
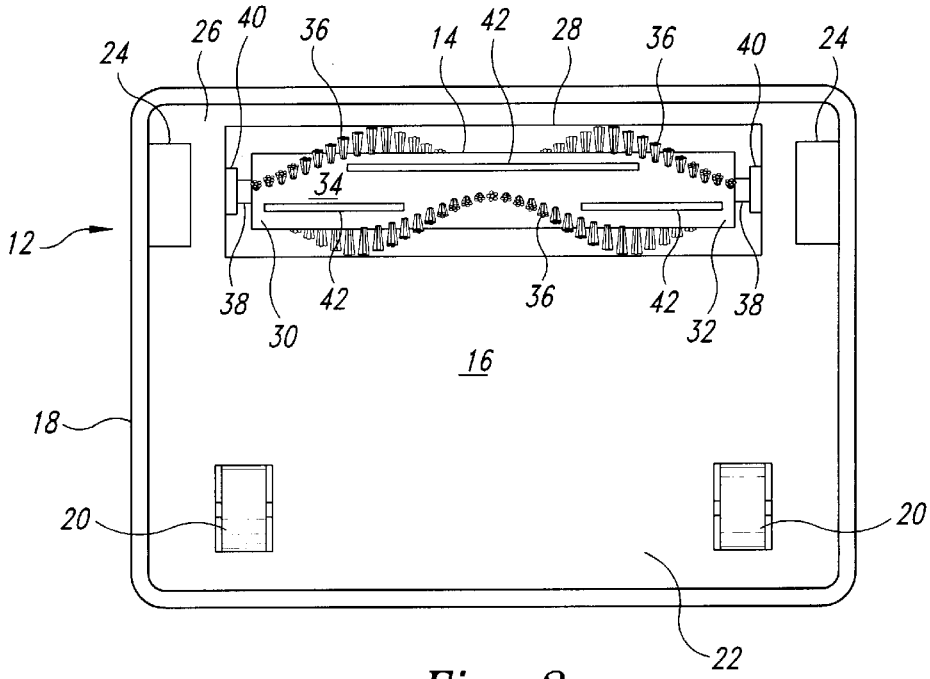
FIG. 2 is an enlarged, bottom plan view of the cleaning machine of FIG. 1.

FIG. 2 illustrates the base 12 of the cleaning machine 10 as viewed from below. A generally flat bottom plate 16 extends over most of the base 12 to cover a number of internal mechanisms (not shown) that, among other things, drive the roller brush 14. A bumper 18 extends around the base 12 to provide a resilient edge for contacting furniture and other objects (not shown). A pair of rear wheels 20 support a rear portion 22 of the base 12 and reduce resistance as a user moves the base 12 across the surface being cleaned (not shown). A pair of front wheels 24 or skids support a front portion 26 of the base 12, and maintain the front portion 26 at a selected height above the surface. An opening 28 in the front portion 26 of the bottom panel 16 exposes a portion of the roller brush 14.

Figure 3:
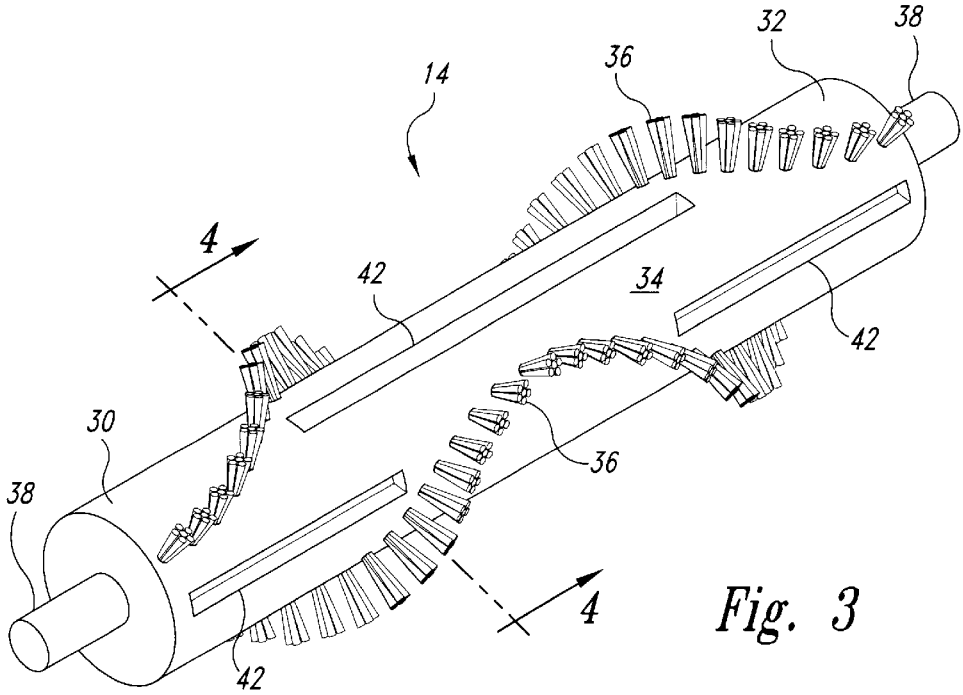
FIG. 3 is an enlarged isometric view of the roller brush of FIG. 1.
Figure 4:
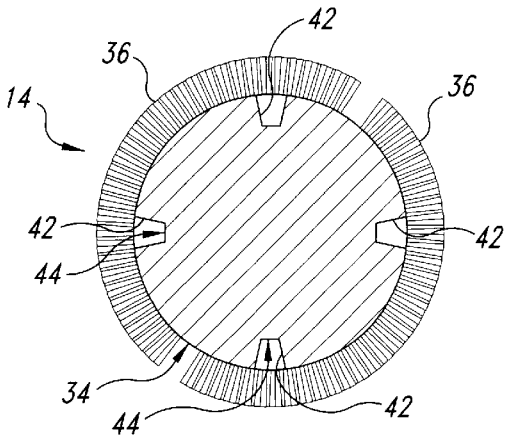
FIG. 4 is a cross-sectional end view of the roller brush of FIG. 3, viewed along Section 4—4.

The roller brush 14, best illustrated in FIG. 3, is a generally cylindrical rotatable member having a first end 30, an opposing second end 32, and an external surface 34 extending between the first and second ends 30,32. The roller brush 14 can be fabricated from wood, polymers, metal or other suitable materials, and can be machined, molded or otherwise formed according to generally understood methods of working with such materials.

A number of projections, such as bristles 36 project from the external surface 34 of the roller brush 14. In the illustrated embodiment, the bristles 36 are elongated fibers each with an end attached to the roller brush 14 and an opposing end projecting from the surface 34 of the roller brush 14. The bristles 36 can be made from various different materials, such as natural hair, polymers, or other suitable materials, and can be attached to the external surface 34 in a variety of generally understood ways. In the illustrated embodiment, the bristles 36 are bunched in a number of tufts that collectively form curved lines along a length of the external surface 34 of the roller brush 14. The orientation of the bristles 36 can also vary considerably based on the type of cleaning that is desired, customer demands, or other factors.

As best illustrated in FIG. 2, the roller brush 14 is mounted inside the front portion 26 of the base 12. An axle 38 at each end 30,32 of the roller brush 14 is mated with a bearing 40 in the base 12, and the roller brush 14 can thus rotate on the axles 38 about an axis of rotation during operation. The roller brush 14 can also be mounted to the base 12 in other manners, such as by bearings attached to the roller brush 14 mated with axles mounted in the base 12. The roller brush 14 is located at a position within the base 12 where the bristles 36 that are oriented toward the opening 28 protrude through the opening 28 and project far enough beyond the bottom panel 16 to contact a surface being cleaned (not shown). Depending on the orientation of the roller brush 14 and the arrangement of the bristles 36, bristles at different points along the length of the roller brush 14 may be in contact with the surface at any given time.

A number of depressions or grooves 42 are positioned about the external surface 34 of the roller brush 14. In the embodiment illustrated in FIGS. 2–4, each groove 42 is elongated and generally rectangular. The grooves 42, however, can have other shapes, such as curves or other rectilinear shapes. As best illustrated in FIG. 3, the grooves 42 in this embodiment are staggered along the length of the external surface 34 of the roller brush 14, and collectively extend along substantially the entire length of the roller brush 14. Each groove 42, however, can instead be continuous along the entire length of the external surface 34, or can be located only at selected locations along its length, depending on the particular use of the roller brush 14, customer demands, bristle pattern, or other factors.

The grooves 42 are positioned such that, at most orientations of the roller brush 14, at least one groove 42 is accessible through the opening 28 in the bottom panel 16 of the base 12 (FIG. 2). In the embodiment illustrated in FIG. 4, the grooves 42 are staggered radially, with one or more grooves 42 being oriented at roughly 90 degree increments around the circumference of the roller brush 14. The grooves 42, however, can be separated by other angles, such as 120 degrees or 180 degrees, based on the configuration of the bristles 36, customer demands, manufacturing constraints, or other factors. In the illustrated embodiment, the bottom 44 of the groove 42 is flat; the bottom 44, however, can have a wide variety of shapes, such as a curve or a V-groove. In the illustrated embodiment, the groove 42 is generally deep enough to receive one side of a pair of scissors, approximately one-eighth of an inch or more.

Each groove 42 can be cut into the external surface 34 of the roller brush 14 after the roller brush is formed, such as with cutting tools, or it can be formed with the external surface 34, such as by a mold.

During operation, the roller brush 14 may become wrapped by hairs, strings or other elongated fibers or material (not shown). The user can remove the fibers by unplugging the cleaning machine, if powered by electricity, inverting the base 12 to expose the roller brush 14, and cutting the fibers. A portion of one side of a pair of scissors or a knife blade (not shown) can fit into the groove 42. The user slides the scissors along the groove 42 until it is under some of the fibers, then cuts the fibers. If the fibers are wrapped around various points along the length of the roller brush 14, the user moves the scissors to another groove 42, then cuts the respective fibers. If necessary, the user can rotate the roller brush 14 to expose a groove 42 that aligns with a particular fiber that needs to be cut. To remove the cut segments from the roller brush 14, the user merely operates the cleaning machine 10 as directed. The fiber segments, when cut short enough, will often be drawn into the cleaning machine 10 by normal operation.

Because the groove allows the user to easily cut fibers wrapped around the roller brush without pulling the fiber away from the external surface, the user can cut the fibers quickly and easily. Also, because the cleaning machine may automatically remove the fiber segments from the roller brush, the user can clean the roller brush without having to handle the hairs or other fibers wrapped around it. As a result, the user may clean the roller brush more often, which, in turn, may allow the roller brush to run longer and more efficiently.

Figure 5:
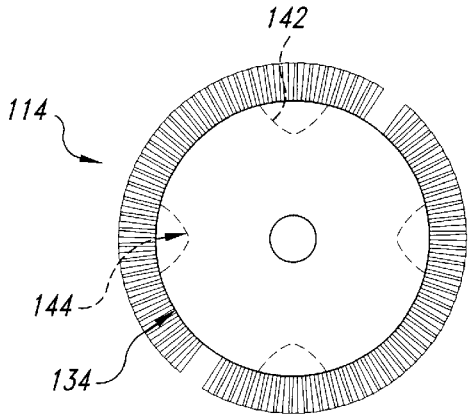
FIG. 5 is an end view of another roller brush according to another embodiment of the present invention.

FIGS. 5–9 illustrate some of the possible alternate embodiments for the present invention. In FIG. 5, a roller brush 114 has a number of grooves 142 positioned about an external surface 134 of the roller brush 114 for receiving a cutting implement (not shown). The roller brush 114 is substantially the same as that described above. A bottom surface 144 of each groove 142, however, has a curved cross-section.

Figure 6:
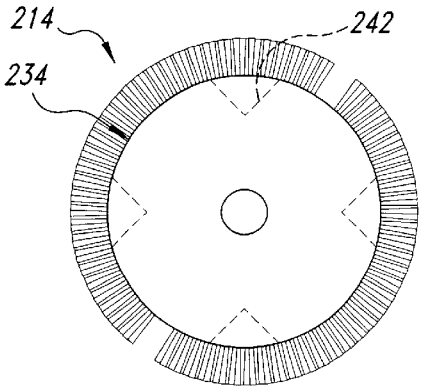
FIG. 6 is an end view of yet another roller brush according to yet another embodiment of the present invention.

In FIG. 6, a number of grooves 242 are positioned about an external surface 234 of a roller brush 214. The grooves 242 have a V-shaped cross-section for receiving either a scissors or a straight blade, such as a razor or knife (not shown). The shape of the grooves 242 can guide the blade along at least a portion of a length of the roller brush 214. The grooves 242 may be made from the same material as the roller brush 214, or may be made from a material that is designed to better resist damage from cutting.

Figure 7:
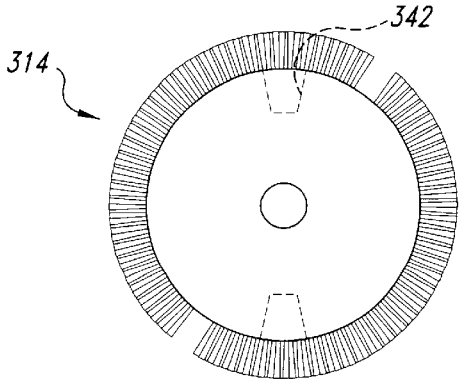
FIG. 7 is an end view of still another roller brush according to still another embodiment of the present invention.

In FIG. 7, a roller brush 314 has a number of grooves 342 oriented roughly 180 degrees apart from each other. The illustrated roller brush 314 has grooves 342 with rectilinear cross-sections. The grooves 342 may be channeled, as illustrated, V-shaped, curved, or have other suitable shapes.

Figure 8:
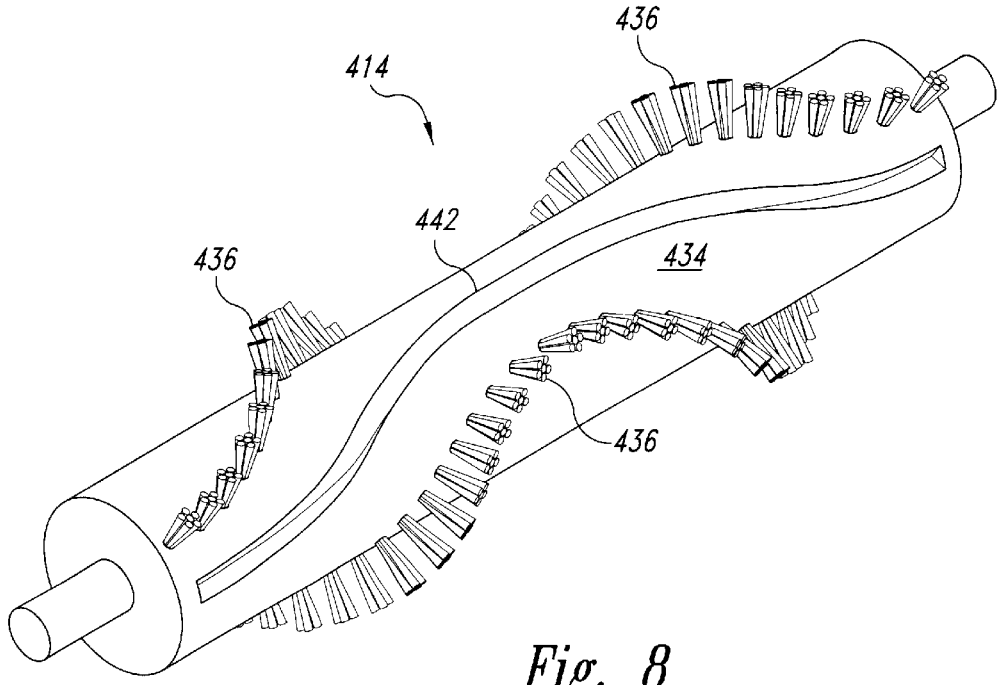
FIG. 8 is an isometric view of still another roller brush according to still another embodiment of the present invention.

FIG. 8 illustrates yet another roller brush 414 according to another embodiment of the present invention. The roller brush 414 has an external surface 434 and a plurality of bristles 436 attached along a length of the roller brush 414. An elongated groove 442 curves along substantially the entire length of the roller brush 414. The roller brush 414 may have one or more grooves 442 spaced radially about the external surface 434. The groove 442 in the illustrated embodiment has a V-shaped cross-section to guide a blade (not shown) along its length in order to cut fibers (not shown) wrapped around the roller brush 414 at any point along its length. The groove 442, however, can have a variety of shapes, and can follow a variety of curves, based on the orientation of the bristles 436, customer demands, or other factors.

Figure 9:
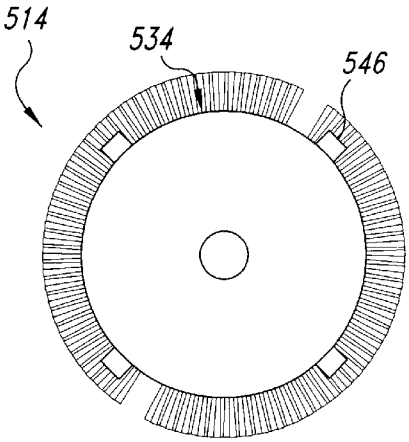
FIG. 9 is an end view of another agitator according to still another embodiment of the present invention.

FIG. 9 shows a roller brush 514 according to still another embodiment of the present invention. The roller brush 514 has an external surface 534 with a number of projections 546 extending outward therefrom. In the illustrated embodiment, the projections 546 are spaced radially roughly 90 degrees apart from each other. The projections, however, can have other spacing, such as 120 degrees or 180 degrees, based on customer demands or other factors. The projections 546 can each extend substantially the entire length of the roller brush 514, or can be staggered and collectively extend substantially its entire length to allow the user to cut fibers therefrom at any point along its length. In the illustrated embodiment, the projections 546 have rectilinear cross-sections. The projections 546, however, can have a wide variety of cross-sections.

The projections 546 raise fibers wrapped around the roller brush 514 above the external surface 534 on either side of each projection 546. The projection can be sized to raise the fiber far enough above the external surface 534 to allow a portion of a scissors to fit under the fiber, such as one-eighth of an inch. The projection 546 may also create a corner 548 on one or both sides of the projection 546 to guide a cutting blade. The roller brush 514 of this embodiment is otherwise used in substantially the same manner as those embodiments discussed above.

Figure 10:
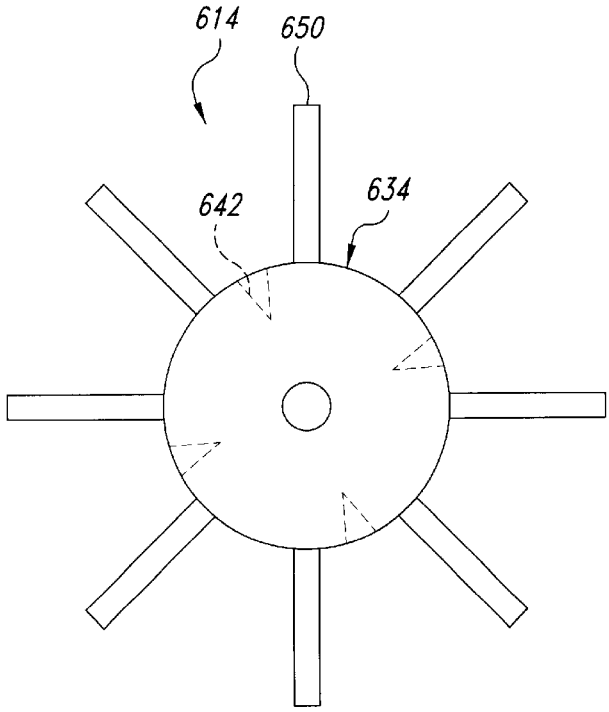
FIG. 10 is an end view of still another agitator according to still another embodiment of the present invention.

FIG. 10 illustrates still another agitator 614 according to still another embodiment of the present invention. The agitator 614 has a number of blades 650 projecting from an external surface 634 of the agitator 614. A number of grooves 642 are positioned radially about the external surface 634 of the agitator 614. Similar to those described above, the grooves 642 can have a variety of sizes and shapes.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An agitator for use with a cleaning machine for cleaning a floor or other surface, the agitator comprising:

a rotatable member having a first end, a second end opposite the first end, an axis of rotation extending between the first and second ends, an external surface extending at least partially between the first and second ends, at least one of the first and second ends being configured to rotatably engage the cleaning machine, a first portion of the external surface being substantially cylindrical about the axis of rotation, a plurality of projections for agitating the surface to be cleaned attached to the first portion of the external surface of the rotatable member, and a second portion of the external surface spaced radially inward from the first portion to form at least a first depression, which is generally rectangular in its transverse cross-sectional shape, elongated and extends roughly helically with respect to the axis of rotation along at least a portion of the length of the external surface, sized and shaped to receive a cutting device to facilitate the cutting or removal of material that becomes wrapped around the rotatable member.

2. The agitator of claim 1, further comprising a second depression in the external surface.

3. The agitator of claim 1, further comprising a second depression in the external surface, the firs depression being located at a first radial orientation with respect to the axis of rotation, the second depression being located at a second radial orientation with respect to the axis of rotation, at least a portion of the first radial orientation being separate from the second radial orientation.

4. The agitator of claim 1, further comprising a second depression in the external surface, he external surface having a length in the general direction of the axis of rotation, the first depression being located along a first portion of the length of the external surface, the second depression being located along a second portion of the length of the external surface, at least a portion of the first portion of the length of the external surface being separate from the second portion of the length of the external surface.

5. The agitator of claim 1, further comprising a second depression in the external surface, the external surface having a length in the general direction of the axis of rotation, the first depression being located along a first portion of the length of the external surface, the second depression being located along a second portion of the length of the external surface, the first portion of the length of the external surface and the second portion of the length of the external surface collectively extending substantially the entire length of the external surface.

6. The agitator of claim 1, further comprising a plurality of second depressions in the external surface.

7. A floor cleaning machine comprising:

an agitator having a first end, a second end opposite the first end, an axis of rotation extending between the first and second ends, an external surface extending at least partially between the first and second ends with the external surface having a length roughly parallel to the axis of rotation of the agitator, at least one of the first and second ends being configured to rotatably engage the cleaning machine, a plurality of bristles attached to the external surface of the rotatable member, and a plurality of depressions in the external surface, which are generally rectangular in their transverse cross-sectional shape, elongated and extend roughly helically with respect to the axis of rotation along at least a portion of the length of the external surface.

8. The floor cleaning machine of claim 7, wherein the plurality of depressions collectively extend substantially the entire length of the external surface.

9. The floor cleaning machine of claim 7, wherein the plurality of depressions are oriented at a plurality of radial orientations with respect to the axis of rotation.

10. The floor cleaning machine of claim 7, wherein the plurality of depressions are oriented at a plurality of radial orientations with respect to the axis of rotation and collectively extend substantially the entire length of the external surface.

* * * * *